US006022451A

United States Patent [19]

Macierewicz

[11] Patent Number: 6,022,451

[45] Date of Patent: Feb. 8, 2000

[54] APPARATUS FOR REMOVING CONTAMINANTS FROM A ROTATING CYLINDRICAL ROLL

[75] Inventor: Jacek Macierewicz, Brockville, Canada

[73] Assignee: James Ross Limited, Ontario, Canada

[21] Appl. No.: 09/042,025

[22] Filed: Mar. 13, 1998

[30] Foreign Application Priority Data

Dec. 9, 1997 [CA] Canada ..... 2224265

[51] Int. Cl.[7] ..... D21G 3/04

[52] U.S. Cl. ..... 162/281; 162/272; 15/308; 34/117

[58] Field of Search ..... 162/272, 280, 162/281; 15/308, 256.51; 34/117, 120

[56] References Cited

U.S. PATENT DOCUMENTS 3,003,176 10/1961 Goyette ..... 15/256.5

3,292,201 12/1966 Bedard ..... 15/308

3,829,927 8/1974 Boyland ..... 15/308

FOREIGN PATENT DOCUMENTS 675443 12/1963 Canada ..... 162/281

*Primary Examiner*—Karen M. Hastings

*Attorney, Agent, or Firm*—Birch, Stewart, Kolasch & Birch, LLP

[57] ABSTRACT

A dryer roll of a paper machine is provided with a doctor assembly, including a doctor blade. A contaminant removal assembly includes a hood mounted in a cantilevered manner to a support extending parallel to the axis of rotation of the dryer roll, and the hood extends downstream from the support and is in sealing contact with the upper surface of the doctor blade to form a channel between the doctor blade, the hood, and the surface of the dryer roll. Air amplifiers are provided at both ends of the hood for creating an airstream extending longitudinally of the hood and exhausting at one end thereof to remove fuzz picked up by the doctor blade on the surface of the dryer roll.

9 Claims, 3 Drawing Sheets

10
12
13
14
16a
17
18
19
20
22
23
24
26
36
38
112
113
116
117

APPARATUS FOR REMOVING CONTAMINANTS FROM A ROTATING CYLINDRICAL ROLL

BACKGROUND OF THE INVENTION

1. Field of the Invention

The present invention relates to a contaminant removal system, and more particularly, to an apparatus for cleaning contaminants from the surface of a dryer roll, in a paper making machine, adjacent a doctor blade.

2. Description of the Prior Art

Doctor blades are utilized, in paper making, to clean the surface of dryer rolls in order to prevent the buildup of fibers and other debris on the surface of the cylindrical dryer roll. U.S. Pat. No. 3,003,176, 1961, Goyette, and U.S. Pat. No. 3,292,201, 1966, Bedard, each describe the use of a hood extending along the edge of the doctor blade combined with air blowers which direct an airstream longitudinally of the hood to move the debris collected by the doctor blade. A suction device may be provided at one end of the hood in order to provide an exhaust for the hood to remove the contaminants from the airstream.

The hoods and blower mechanisms of the above prior art are mounted on the support for the doctor blade and can be pivoted and adjusted relative to the doctor blade edge. These supports are generally rigid, and the mounting of the contaminant removal mechanism does not pose too much of a problem although the doctor support mechanism is often masked by this additional structure and adjustment of the doctor blade may become difficult. Since the hoods are generally mounted on the doctor blade support, they must extend forward of the blade edge upstream of the direction of rotation of the roll, and over the surface of the roll. Thus, a flexible skirt must be provided which will be in contact or at least closely associated with the moving surface of the roll upstream of the blade edge. Thus, the hood will be subject to wear because of friction and may also accumulate debris on the outside surface of the hood, requiring further cleaning.

Due to the high speed of the rolls, a boundary layer is formed which moves in the same direction as the roll, thus against the leading edge of the hood or the skirt on the hood. This boundary layer may be at least 0.5 inch thick, thereby reducing the energy efficiency of the prior art devices since enhanced suction devices are required.

Since the known contaminant removal systems extend upstream in a cantilever manner, they can only deflect forwardly and away from the surface of the roll, which might be damaged in the event of a paper break.

Modern doctor blades are often mounted on pneumatic doctor blade support mechanisms which are flexible in nature and cannot support a contaminant removal system of the type described in the prior art.

SUMMARY OF THE INVENTION

It is, therefore, an aim of the present invention to provide a contaminant removal system which is mounted independently of the doctor blade assembly and thus can be associated with rigid or flexible blade mounting systems.

It is a further aim of the present invention to provide a contaminant removal assembly that can be adapted to doctor blades mounted on flexible supports, such as pneumatically loaded supports as well as on doctor blades mounted on conventional rigid blade supports.

It is a further aim of the present invention to provide a mechanism for a contaminant removal system which is pivotally mounted upstream of the doctor blade and extends in a cantilevered manner downstream of the direction of rotation of the roll, whereby the mechanism is merely deflected in the event of a paper break. Furthermore, the hood of the contaminant removal assembly is not confronting the boundary layer.

It is a still further aim of the present invention to provide a cantilevered hood for a contaminant removal assembly which is mounted on a support upstream of the doctor blade, and an edge of the hood is in sealing contact with the doctor blade, not with the moving surface of the roll, thereby reducing the wear and tear on the hood.

A construction in accordance with the present invention comprises a contaminant removal assembly for removing contaminants from a surface of a cylindrical roll, wherein the roll has a direction of rotation about an axis of rotation, the assembly comprising an elongated support member having an axis of rotation parallel to the axis of the roll, a hood extending longitudinally of the support member and mounted in a cantilevered manner to the support member for pivoting movement therewith, the hood member extending downstream of the support and over the surface of the roll, means for creating an airstream between the hood and the surface of the roll in the longitudinal direction of the hood, exhaust means at an end of the hood whereby contaminants borne by the airstream will be removed from the area between the hood and the surface of the roll.

In a more specific embodiment of the present invention, a doctor assembly is provided with a doctor blade extending in a plane parallel to the axis of rotation of the roll, the contaminant removal assembly is located adjacent but upstream of the doctor assembly with the hood extending downstream from the support member over and in sealing contact with the doctor blade to form an airstream channel between the surface of the roll, the doctor blade, and the hood.

In a still more specific embodiment of the present invention, the cylindrical roll is a dryer roll in a paper machine, and the doctor blade is in contact with the surface of the dryer roll while the contaminant removal assembly includes a support mounted independently of the doctor assembly and upstream thereof with the hood extending downstream and in sealing contact with the doctor blade to form the airstream channel for removing fuzz and other debris picked up by the doctor blade.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
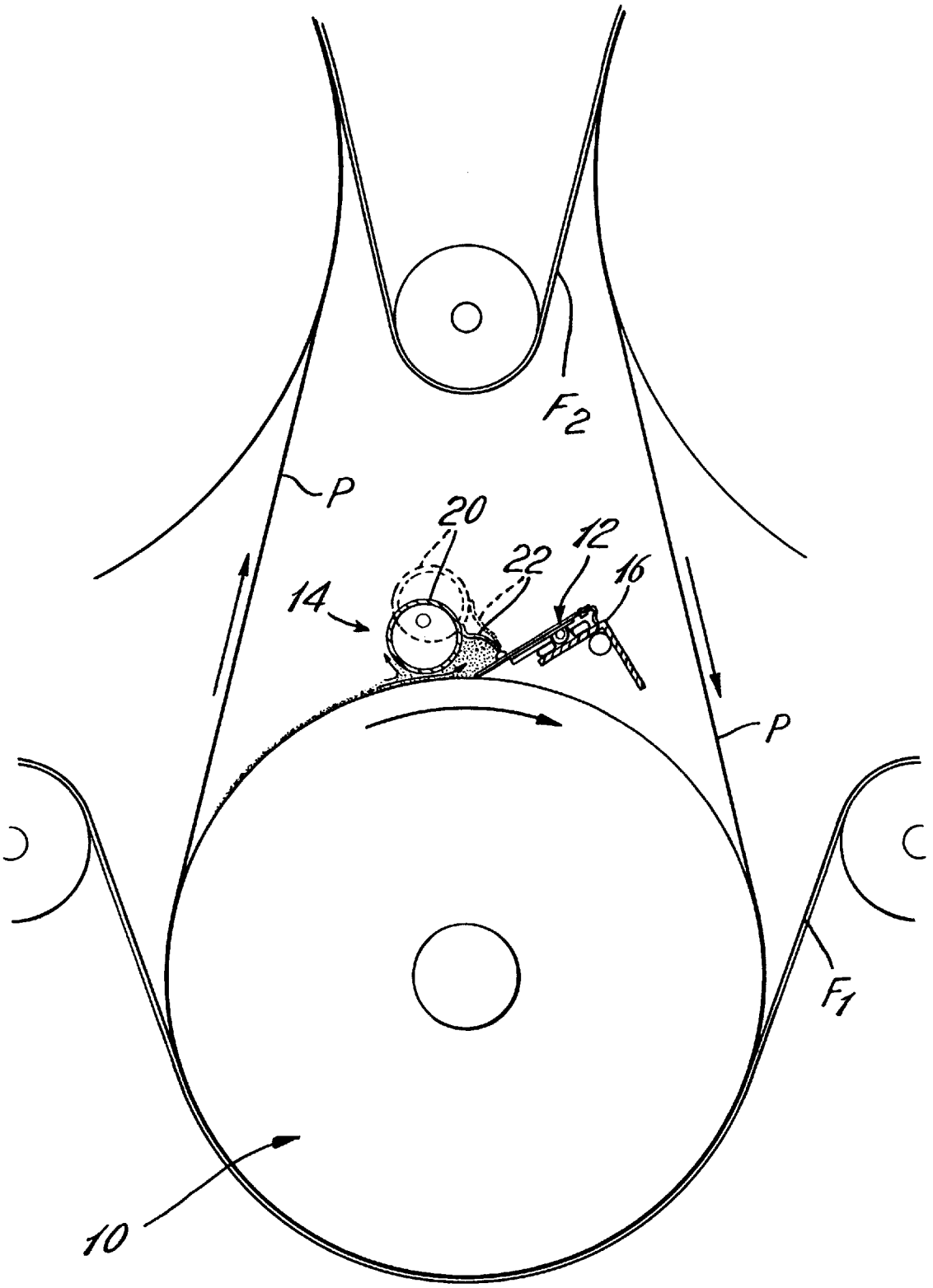
FIG. 1 is a schematic side elevation of a portion of the dryer section of a paper making machine.

A typical arrangement of a dryer section of a paper machine is shown in FIG. 1. Cylindrical dryer rolls 10 are empty metal cylinders heated with steam from the inside and rotating to convey the paper web P from the wet to the dry end of a machine. Bottom dryer fabric $F_1$ and top dryer fabric $F_2$ press the paper web to the dryer rolls 10 to guide it and enhance moisture evaporation therefrom. It is understood that paper sheets P which are not fully set will deposit fibers, filler material, and other contaminants from recycled furnishes on the surface of the roll 10. Doctors 12 are used to scrape off the debris from the roll surface to prevent uneven buildup which might cause sheet breaks and uneven heat transfer.

Unfortunately, the doctored debris in the form of dust, fuzz, and flecks will merely fly up and out to the sides of the dryer section. Occasionally, some fuzz balls will be formed and be carried by hot air currents to enter between the bottom roll 10 and the sheet P or between the sheet P and the top dryer fabric $F_2$, thus breaking the sheet P.

Typical dryer rolls of four, five, or six feet in diameter rotate at speeds of between 1,000 to 4,000 fpm and thus develop a boundary layer 36 pumped towards the doctor blade area. This boundary layer 36 will amount from 0.4 to 1 inch in thickness, supplying between 3 to 10 cfm/inch (cubic feet per minute per linear inch) along the surface of the roll.

Figure 2:
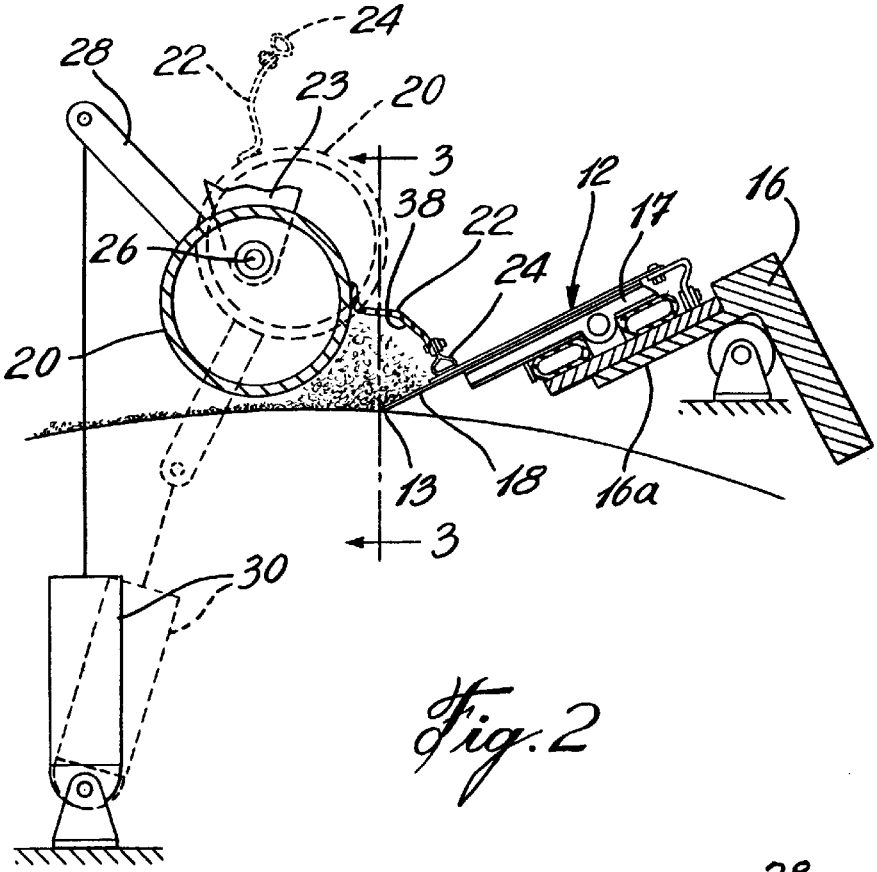
FIG. 2 is an enlarged fragmentary vertical cross-section taken longitudinally of the dryer section, with some elements shown schematically.
Figures 4, 5:
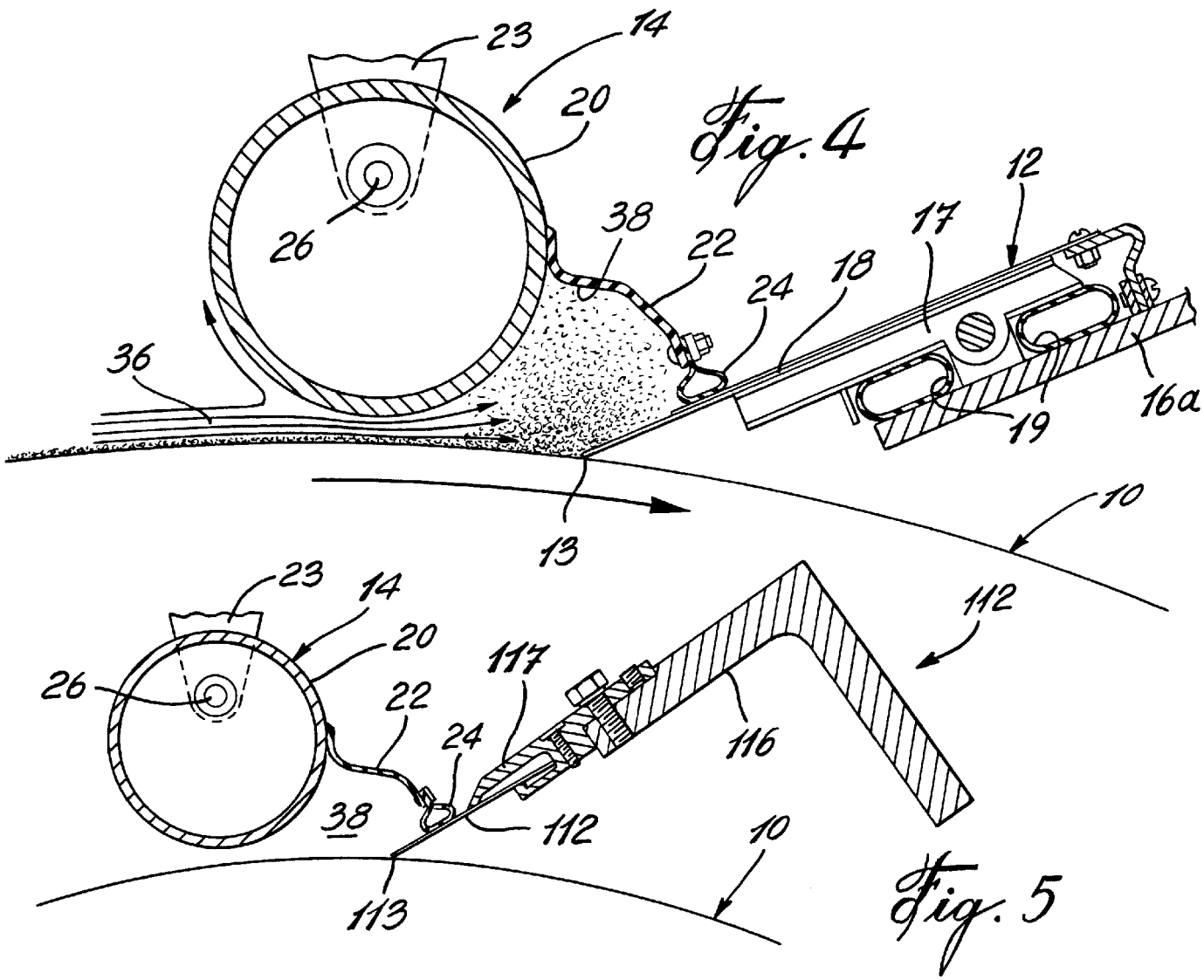
FIG. 4 is an enlarged fragmentary vertical cross-section, similar to FIG. 2.
FIG. 5 is a fragmentary vertical cross-section, similar to FIG. 4, but showing a different doctor.

A doctor blade assembly 12 is shown in FIGS. 2 and 4 as having a support structure 16. This support structure 16 will normally be pivotally mounted and operated by a piston and cylinder arrangement (not shown). The doctor blade assembly 12, shown in FIGS. 2 and 4, is of the pneumatic type, including a support plate 16*a* to which a blade holder 17 is mounted. Blade 18 has a scraping edge 13 in contact with the surface of the roll 10. Pneumatic tubes 19 can be adjusted to pivot the holder 17. By adjusting the pneumatic tubes 19, a variable load can be applied to the blade 18 against the surface of the dryer roll 10.

A rigid doctor blade assembly 112 is shown in FIG. 5 in which the pivoted holder mounts a clamping device 117 which, in turn, clamps the blade 112. Blade 112 has a scraping edge 113.

The contaminant removal assembly 14, as shown in FIGS. 2 to 5, includes a carrier in the form of a pipe 20 which is eccentrically mounted about an axis 26. The axis of rotation of the eccentrically mounted pipe 20 extends parallel to the axis of rotation of the roll 10. Support brackets 23 are shown schematically in the drawings to illustrate that the carrier is mounted to a frame (not shown). An actuator device 28 is connected to a piston and cylinder 30, as shown in FIG. 2, for rotating the pipe 20 from an operative position, as shown in FIGS. 2, 3, 4, and 5, to a rest position, as shown in dotted lines in FIG. 2. The pipe 20 may be between 3 and 10 inches in diameter, depending on the lengths which might range from 180 to 400 inches.

The pipe 20 supports a hood 22 which, in turn, mounts a tubular flexible seal 24. The seal may be a thin, high temperature, and wear resistant flexible material and is adapted to contact the doctor blade 12 without exerting pressure on the doctor blade assembly. When the hood is in its operative position, as shown in FIG. 4, for instance, the boundary layer 36 enters a gap formed between the pipe 20 and the surface of roll 10. This gap should be controlled between 0.25 and 0.50 inch. The area between the doctor blade 18, the surface of the roll 10, and the hood 22 as well as the pipe 20, determines the evacuation channel 38.

Figure 3:
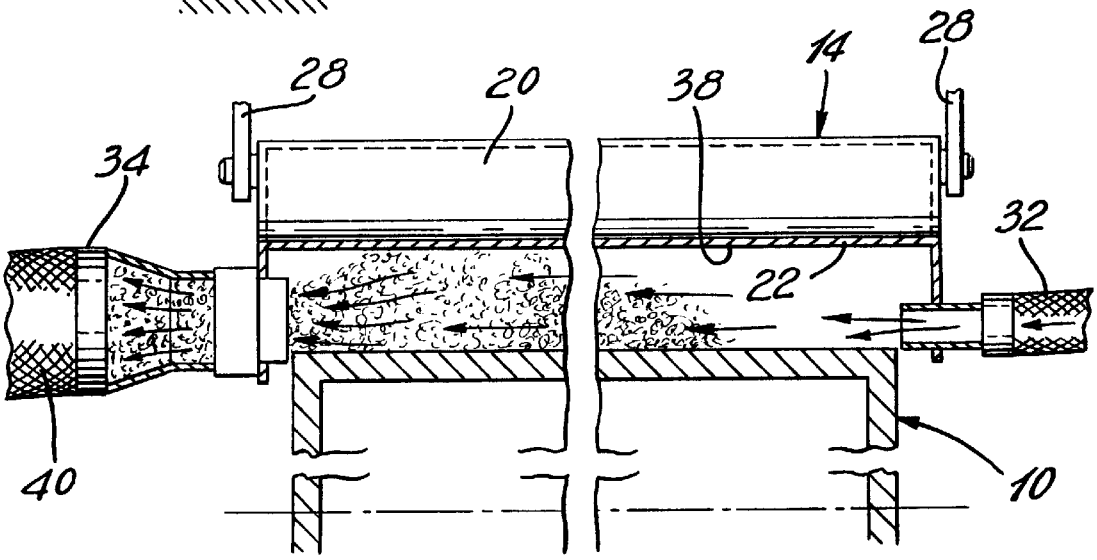
FIG. 3 is a vertical cross-section taken along line 3—3 of FIG. 2.

FIG. 3 shows the evacuation channel 38 to which a small air amplifier 32 is located at one end thereof, on the side of the paper machine. In one example, an EXAIR™ (EXAIR Corporation) amplifier model 6020 was used. With approximately 4 to 5 scfm (cubic feet per minute) and a pressure of 50 to 80 psi, the air amplifier pumps 24 to 31 cfm of air into the channel with an initial velocity of over 10,000 fpm. This so-formed airstream picks up the fuzz and debris in the channel area formed over the doctor blade 18. At the other end of the channel is found a larger air amplifier 34. Using 13 to 19 scfm of compressed air at 50 to 80 psi, the air amplifier 34 can evacuate between 190 to 270 scfm into the outlet hose 40. Hose 40 leads the contaminants and airstream to a separating/collecting cyclone without the need of a vacuum pump or blower.

The combination of the pumping action of the air amplifiers and the redirection of the boundary layer 36 as it enters the channel 38 provides velocities well above 5,000 fpm sufficient to remove the fuzz from the top of the doctor blade 18.

In the event of a very wide paper machine, that is, where a hood of 400 inches may be required, an additional air amplifier may be required midway of the hood 22.

I claim:

1. A contaminant removal assembly for removing contaminants from a surface of a cylindrical roll, wherein the roll has a direction of rotation about an axis of rotation of the roll, the assembly comprising an elongated support member having an axis of rotation of the support member parallel to the axis of rotation of the roll, a hood extending longitudinally of the support member and mounted in a cantilevered manner to the support member for pivoting movement therewith, a doctor assembly provided for doctoring the surface of the roll, the doctor assembly comprising a doctor support and a doctor blade mounted to the doctor support and extending upstream of the doctor support and having an edge in contact with the surface of the roll; the doctor support and the doctor blade extending parallel and spaced apart to the axis of rotation of the roll and the axis of rotation of the support member, the support member being spaced apart from the doctor blade assembly, and the contaminant removal assembly is positioned upstream of the doctor assembly and adjacent thereto, the hood extending downstream of the support member and over the surface of the roll, the hood including flexible seal means extending longitudinally along an edge of the hood and adapted to come into sealing contact with an upper surface of the doctor blade, means for creating an airstream between the hood, the surface of the roll and the doctor blade in the longitudinal direction of the hood, exhaust means at an end of the hood whereby contaminants borne by the airstream will be removed from the area between the hood and the surface of the roll.

2. A contaminant removal assembly as defined in claim 1, wherein the support member is eccentrically mounted for pivoting movement between a rest position and an operative position, and the flexible seal on the edge of the hood is in contact with the upper surface of the doctor blade when the support member is in the operative position.

3. A contaminant removal assembly as defined in claim 1, wherein there is a space between the support member and the surface of the roll to allow a boundary layer to pass between the support member and the surface of the roll to enter the area between the hood and the surface of the roll.

4. A contaminant removal assembly as defined in claim 2, wherein the hood, the flexible seal, the doctor blade, and the surface of the roll define an airstream channel having an axis parallel to the axis of rotation of the roll and enclosing said airstream.

5. A contaminant removal assembly as defined in claim 4, wherein there is a space between the support member and the surface of the roll to allow a boundary layer to pass between the support member and the surface of the roll to enter the airstream channel.

6. A contaminant removal assembly as defined in claim 1, wherein the roll is a dryer roll for a paper machine and the doctor blade is in contact with the surface of the dryer roll, and the exhaust means between the hood and the surface of the dryer roll will be effective for removing fuzz and other debris picked up by the doctor blade.

7. A contaminant removal assembly as defined in claim 6, wherein the exhaust means includes an air amplifier at one end of the hood for pumping air along the axis of the airstream, and the exhaust means includes a second air amplifier at the other end of the hood for enhancing the airstream and removal of the contaminants from the area between the hood and the doctor blade.

8. A contaminant removal assembly as defined in claim 7, wherein the air amplifier at the one end of the hood can pump approximately 4 to 5 scfm at a pressure of 50 to 80 psi, thereby pumping 24 to 31 cfm of air forming the airstream, and at the other end of the channel the air amplifier produces 13 to 19 scfm of compressed air at 50 to 80 psi, thereby evacuating 190 to 270 scfm.

9. In a dryer section of a paper making machine having a dryer roll, a contaminant removal assembly in the form of a kit is mounted to a frame of the dryer roll upstream of a doctor blade assembly for the dryer roll, wherein the contaminant removal assembly includes a support member which extends parallel to an axis of rotation of the dryer roll, the support member being spaced apart from the doctor blade assembly, and a hood extending from the support member downstream therefrom to overlap and be in sealing contact with a doctor blade of the doctor assembly to thereby form an airstream channel between a surface of the dryer roll, the doctor blade, and the hood, the support member being spaced radially from the surface of the roll to provide a gap to allow a boundary layer to enter the airstream channel; means for creating an airstream longitudinally of the channel for removing fuzz and other debris picked up by the doctor blade and moving the fuzz and debris with the airstream in the channel outboard of the dryer roll.

* * * * *